United States Patent [19]

Moss et al.

[11] 4,100,004

[45] Jul. 11, 1978

[54] METHOD OF MAKING CARBON FIBERS AND RESIN-IMPREGNATED CARBON FIBERS

[75] Inventors: Maurice Moss, Mougins, France; Colin Barry Hill; Michael Roger Rowland, both of Wilmslow, England

[73] Assignee: Securicum S.A., Geneva, Switzerland

[21] Appl. No.: 771,740

[22] Filed: Feb. 24, 1977

Related U.S. Application Data

[63] Continuation-in-part of Ser. No. 685,427, May 11, 1976, abandoned, which is a continuation of Ser. No. 471,279, May 20, 1974, abandoned.

[51] Int. Cl.[2] ..... B32B 31/18; D01F 9/22

[52] U.S. Cl. ..... 156/60; 156/181; 156/271; 423/447.2; 423/447.4; 423/447.6; 423/447.8; 264/29.2

[58] Field of Search ..... 423/447.6, 447.7; 264/29.2; 8/115.5; 427/227, 172, 175; 156/60, 181, 271

[56] References Cited

U.S. PATENT DOCUMENTS

| | | | |
|---|---|---|---|
| 3,533,743 | 10/1970 | Prescott et al. | 423/447.6 |
| 3,539,295 | 11/1970 | Ram | 423/447.6 |
| 3,552,923 | 1/1971 | Carpenter et al. | 423/447.6 |
| 3,700,511 | 10/1972 | Whitney et al. | 156/60 |
| 3,723,157 | 3/1973 | Druin | 117/46 CB |
| 3,914,960 | 10/1975 | McGuffin et al. | 423/447.6 X |

FOREIGN PATENT DOCUMENTS

| | | | |
|---|---|---|---|
| 2,211,639 | 9/1973 | Fed. Rep. of Germany | 423/447.6 |
| 2,045,680 | 4/1971 | Fed. Rep. of Germany | 423/447.6 |

*Primary Examiner*—Edward J. Meros
*Attorney, Agent, or Firm*—William R. Liberman

[57] ABSTRACT

A multifilament sheet, tow or web of acrylonitrile precursor fibres are passed through a pre-heat zone at a temperature at least 100° C below the critical temperature. The material is then passed through a two-stage oxygenation zone comprising a first stage at 220° to 250° C and a second stage at 260° to 300° C. The material passes straight through the oxygenation zone and is held in sufficient uniform tension to stretch the fibres during heating and oxygenation. The oxygenated material is then passed through a carbonizing zone comprising at least one stage at 1050° to 1600° C under non-oxidizing conditions. The resulting carbon fibre has a mean Young's modulus of at least $25 \times 10^6$ p.s.i. and a mean tensile strength of at least 250,000 p.s.i.

17 Claims, 17 Drawing Figures

21
17
18
16
20
E
19
3
15
14
13
D
81
3
10
11
9
12
C
31
3
8
16
7
5
4
B
3

E
D
45
44
81
C
B
46

METHOD OF MAKING CARBON FIBERS AND RESIN-IMPREGNATED CARBON FIBERS

This application is a continuation in part of application Ser. No. 685,427 (filed 11th May 1976), which is a continuation of application Ser. No. 471,279 (filed 20th May 1974) both now abandoned.

This invention relates to the making of carbon fibre from carbon-containing precursor fibre.

Various prior methods have been proposed for making carbon fibre by the carbonising of precursor fibres such as polyacrylonitrile fibre which is kept under tension during heat treatment and carbonizing.

The methods proposed hitherto have suffered from a number of disadvantages including the difficulty of maintaining progressive increases in temperature in the carbonising zone, the cost of apparatus and operating difficulties.

It is an object of this invention to overcome these disadvantages and in particular to provide a method of making carbon fibre which has the virtues of greater simplicity and reduced cost as compared with prior proposals, and which yields a more uniform product with inter alia an improved Young's modulus and an improved tensile strength.

According to our invention, we provide a method of making carbon fibre, comprising passing a multifilament sheet, tow or web of precursor fibres formed of an acrylonitrile polymer or copolymer through a pre-heat zone maintained at a temperature at least 100° C below the critical temperature of the fibres; passing the pre-heated multifilament sheet, tow or web through an oxygenation zone comprising at least two stages, namely, a first stage in which the multifilament sheet, tow or web is contacted with an oxygenation medium selected from the group consisting of oxygen and oxygen-containing gases, gradually heated up to a first temperature in the range of from 220° to 250° C, at which the fibres are able to take up oxygen without degradation and maintained at that temperature and a second stage in which the partly oxygenated multifilament sheet, tow or web of fibres is further heated in the presence of an oxygenation medium to a second higher temperature, in the range of from 260° to 300° C, and is maintained at that second temperature, the multifilament sheet, tow or web of fibres passing straight through the oxygenation zone and being held in sufficient uniform tension in the oxygenation zone to stretch the fibres during heating and oxygenation; and thereafter passing the multifilament sheet, tow or web of oxygenated fibres through a carbonizing zone comprising at least one stage in which the multifilament sheet, tow or web of fibres is heated to a third elevated temperature in the range of from 1050° to 1600° C, under non-oxidizing conditions to yield a fibre with a mean Young's modulus of at least $25 \times 10^6$ p.s.i. and a mean tensile strength of at least 250,000 p.s.i.

Generally, the multifilament sheet, tow or web is initially heated (e.g. to 100° – 160° C, preferably 130° C) whilst being held under sufficient tension to remove crimp and to stretch the fibres uniformly by up to 75%. The heat is usually two heated plates above and below the fibre web, but an oven, steam heater or dielective heater can also be used. The multifilament sheet, tow or web is then passed to the pre-heat zone.

The division of the oxygenation zone into at least two stages allows a precise choice of the temperature levels at which the desired physical and chemical changes in the fibre occur. Thus, it is possible by having at least two oxygenation stages to ensure that the first stage, which the pre-heated fibre enters, is at a temperature chosen to give optimum results. An important further feature of the first oxygenation stage is an inlet conduit acting as the pre-heat zone in which a temperature gradient is established. This allows a gradual warm-up of the fibre entering the oxygenation stage.

The residence time of the multifilament sheet, tow or web in the pre-heat zone is generally from 10 to 30 minutes, and the temperature of this zone is generally from 170° to 200° C, i.e. at least 100° C below the critical temperature of the fibre (about 300° C).

The multifilament sheet, tow or web is generally passed through each oxygenation stage for a plurality of passes, e.g. at least 3 passes, to thereby allow extended contact between the fibres and the oxygenation medium.

On passage through the two oxidation stages, the fibres are generally stretched by a minimum of 50% to reduce their cross-sectional area — measured after carbonising — to less than 38 sq. microns and preferably to not more than 35 sq. microns. This high stretch applied whilst the fibres are undergoing oxidation has been found to greatly increase the fibre properties and increase the uniformity of the product.

The oxygenation treatment time generally varies from 2 to 4 hours and the carbonising residence time usually includes a period of about 20 to 30 minutes at up to 1600° C.

We prefer to use a carbonising zone which comprises at least two stages to that we can again choose different temperature levels for the different carbonising stages through which the fibre passes. The different stages are, of course, at progressively higher temperatures. Thus, the carbonising zone preferably comprises at least two stages, namely, a first stage in which the multifilament sheet, tow or web of fibres is heated at a first elevated carbonizing temperature in the range of from 600° to 700° C and a second stage in which the fibres are heated at a second, higher, elevated carbonising temperature in the range of from 1050° to 1600° C, the carbonizing zone being maintained under non-oxidizing conditions.

The use of additional carbonising stages at higher temperatures than 1600° C allows the Young's modulus and the tensile strength to be improved. The tensile strength generally improves with carbonising up to about 1400° C and thereafter declines with increasing temperature. The Young's modulus will increase continuously with additional heat treatments up to 2,000° C. and beyond, i.e. up to a possible 3,000° C. In this way, values for Young's modulus of from $30 \times 10^6$ to $40 \times 10^6$ p.s.i. and for tensile strength of between 300,000p.s.i. and 450,000 p.s.i. or even higher can be obtained by proper choice of heat treatments. In a preferred embodiment, we produce fibres with consistent properties of Young's Modulus of $34 \times 10^6$ p.s.i. and ultimate tensile strength of 500,000p.s.i.

In general, the precursor fibre may be any polyacrylonitrile fibres known to be suitable for carbonising and optionally graphitising. Commercially available polyacrylonitrile fibre, e.g. that sold under the trade means "Orlon" and "Dralon" is particularly suitable but other polyacrylonitriles, whether pretreated or not, may be used. We may also use copolymers, including terpolymers of acrylonitrile and other compatible monomers, e.g. methyl methacrylate or vinyl acetate. Alternatively, we may use compatible mixtures of acrylonitrile with one or more other polymers and/or copolymers.

The precise temperatures employed in the oxygenation and carbonisation systems vary according to the type of precursor fibre employed.

Previous methods of making carbon fibre have dealt with specially produced precursors having a minimum input denier of 1.5 and no significant stretch to these fibres has been applied during oxidation other than the restraining of the shrinkage forces set up as the fibres oxidise. Some methods do mention fibres greater than 1.5 denier but do not state that they are stretched in the oxidation stage but are usually prepared and stretched to about 1.5 denier before undergoing oxidation. Using our process, we can uniformly stretch fibres to give filament deniers as low as 1.0 with considerably higher resulting ultimate tensile strength and modulus compared with prior methods.

We have shown that to achieve reliability and uniformity of properties, very high extensions, i.e. stretch, have to be applied to the fibres in the oxidation ovens. Also, our system does not employ any internal rollers or capstans around which the fibres pass, and we can consistently and uniformly produce fibre with Young's modulus of $34 \times 10^6$ p.s.i. and ultimate tensile strength of 500,000 p.s.i. Using a capstan arrangement of rollers (i.e. two grooved rollers around which the fibres pass many times) no stretching of the fibres between one roller and the other is possible because of the change of breaking strain of the fibre as it advances in oxidation. Thus, all the tensions would not equalise and breakage of the fibre would result. Therefore such a system is unworkable.

Other systems employing many rollers to convey the fibres through the oxidation ovens could not be made to operate such that elongation of the fibres could occur whilst passing those fibres through the ovens in an oxidation stage. Our system has been specifically designed to accept large wide webs of longitudinally aligned precursor fibres made from several large filament count heavy tows of polyacrylonitrile fibre which are commercially available on the world market.

There are difficulties in processing large numbers of filaments simultaneously, i.e. as found in commercial heavy tow, rather than the small bundles of filament aligned into a small tow of 10,000 filaments or less, and currently being specially manufactured for use by most of the world's carbon fibre producers. In practice, other systems cannot be made to operate using heavy tow — not only because of the capstan effect and other handling problems, but because of the very high exothermic heat produced when large amounts of polyacrylonitrile undergo oxidation.

In operation our system can process up to 1,000 times more fibre per unit volume of oven than is possible as shown by the mechanics of other systems. This necessitates the removal of the exothermic heat produced in oxidation. Otherwise, disastrous runaway reactions will occur. Such runaway reactions do not necessarily occur in other systems simply because the packing of fibres in such systems is very much less than in our system. Other systems, therefore, tend to be more complex, expensive and unreliable to operate.

In our system, exothermic heat is carried away by very large quantities of air directed to flow around the ovens and through the fibre webs in a precisely controlled manner. Very accurate temperature control in the oxidation stage ensures that no hot spots occur — these obviously would trigger off a runaway exothermic reaction.

Reference is now made to the accompanying drawings, in which.

Figure 1:
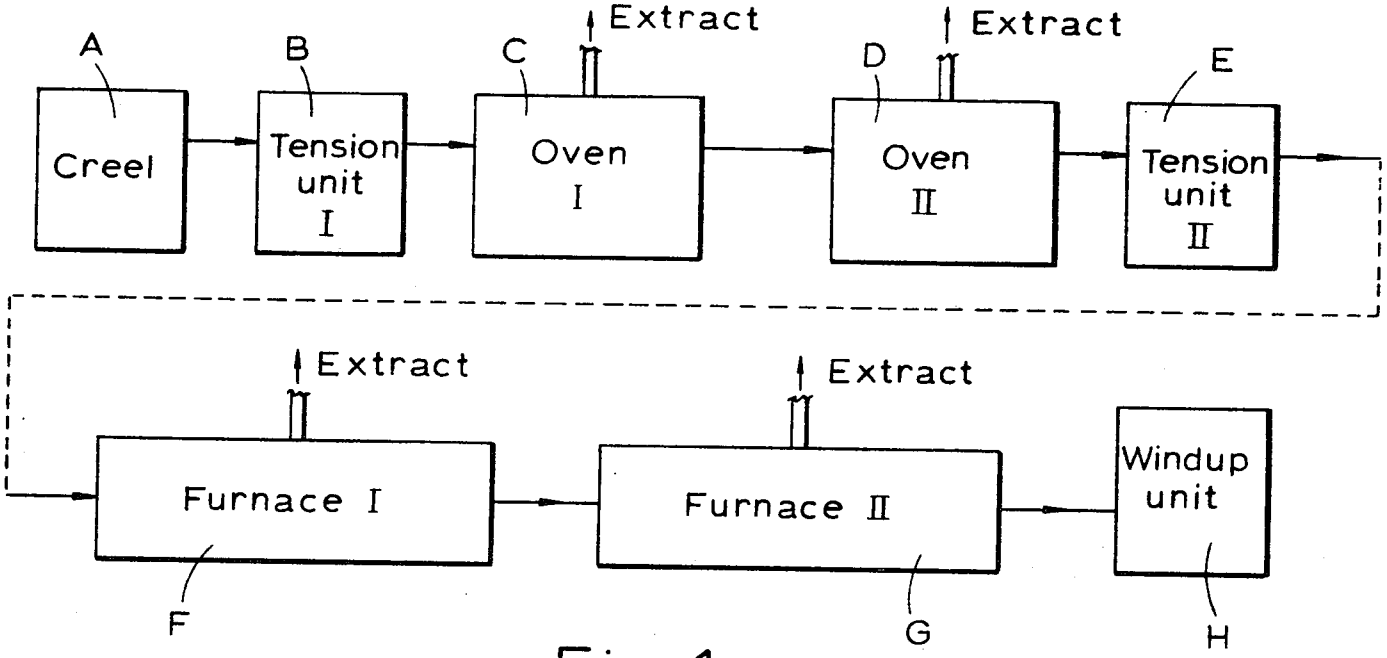
FIG. 1 is a flow sheet of one embodiment of a method of making carbon fibre in accordance with this invention.
Figure 8:
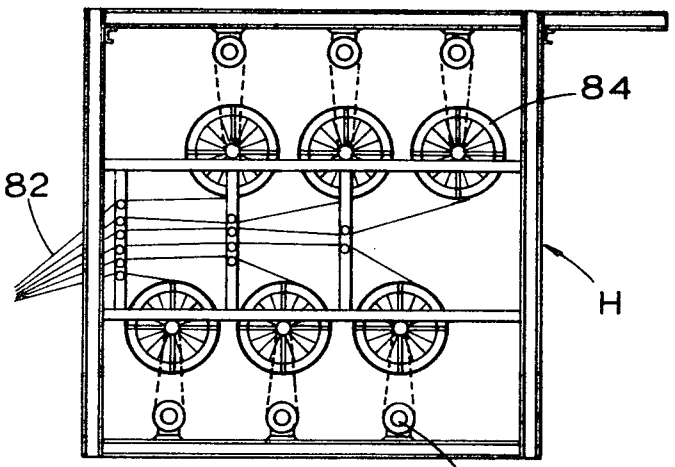
FIGS. 2, 4, 6 and 8 are diagrammatic side elevations of individual units of the apparatus of FIG. 1.
Figure 9:
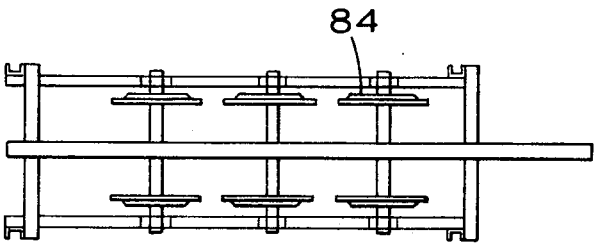
FIGS. 3, 5, 7 and 9 are corresponding plan views.
Figure 2:
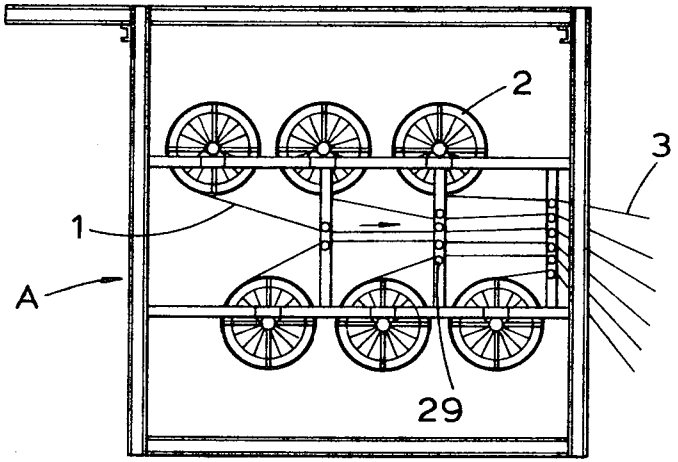
Figure 3:
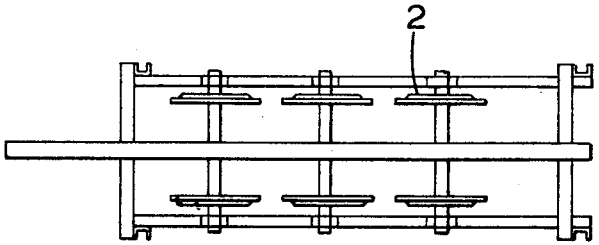
Figure 4:
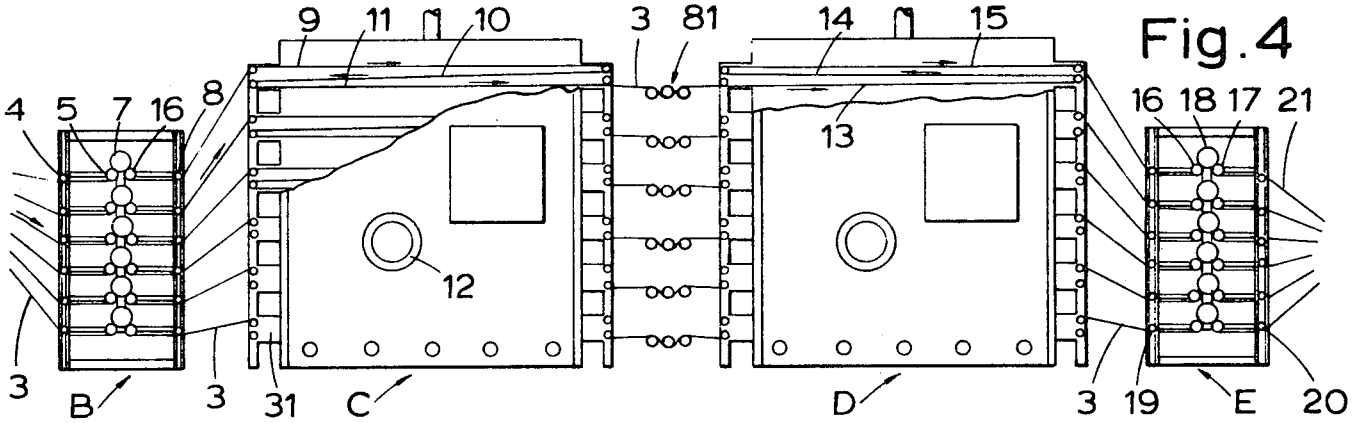
Figure 5:
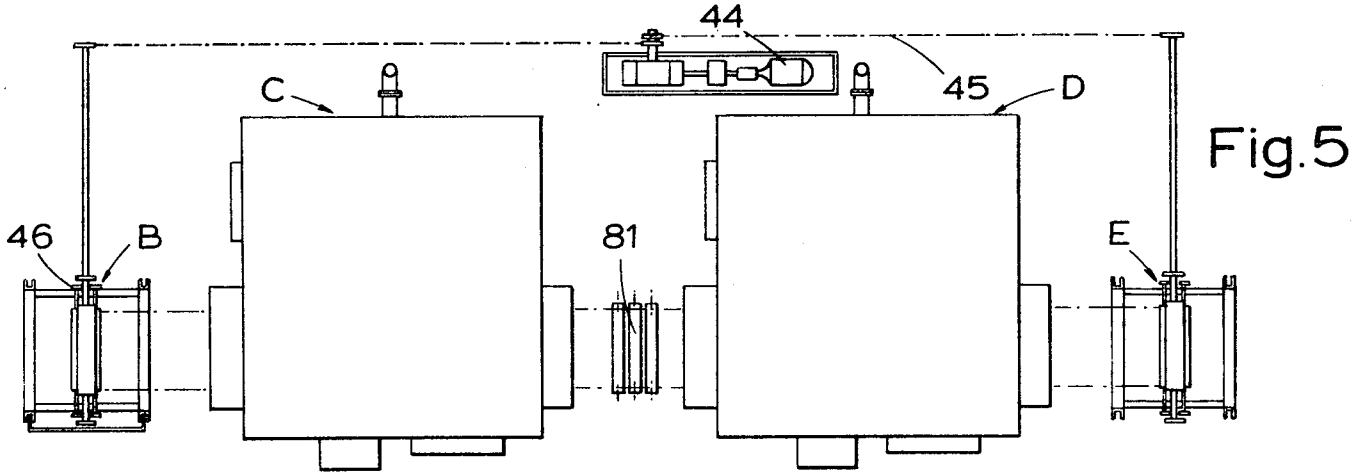
Figure 6:
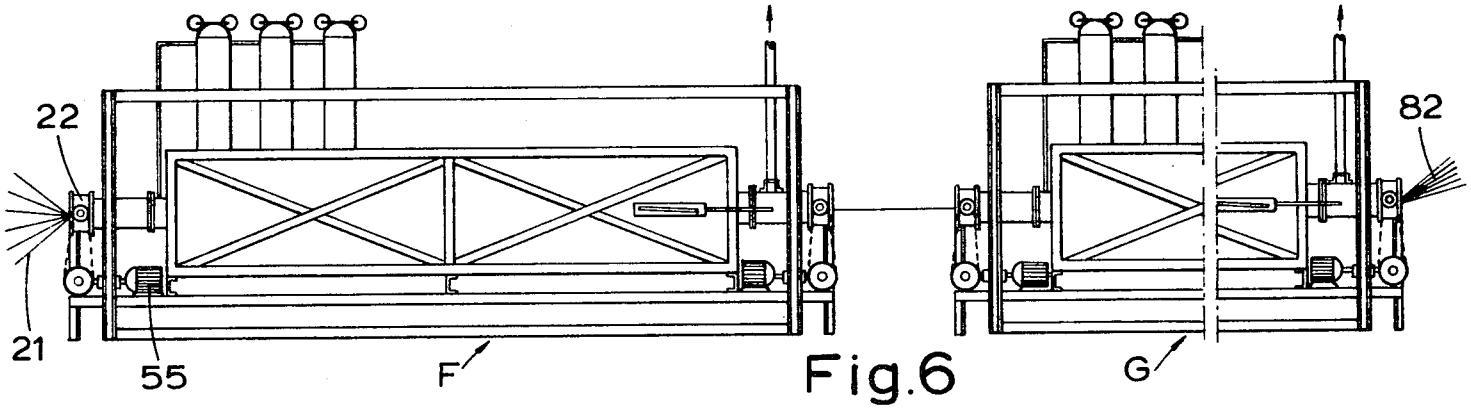
Figure 7:
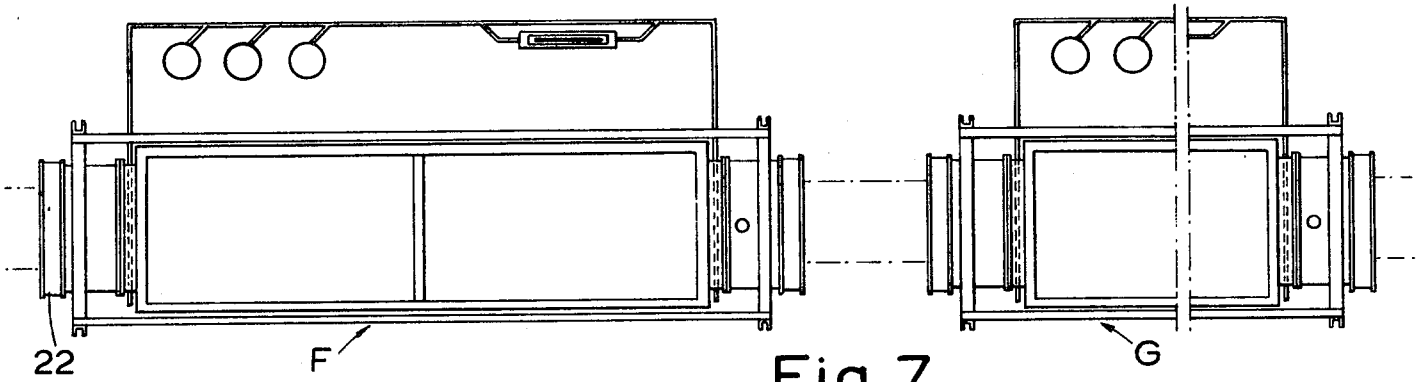

The apparatus shown in FIG. 1 comprises units A to H, namely a creel unit A, a first drive unit B, a two-stage oven C-D, a second drive unit E, a two-stage furnace F - G, and a wind-up unit H.

The creel unit A, which is of conventional construction, comprises on two levels six reels 2 from which the fibre 1 is unwound via idler rolls 29 and fed to the drive unit B in six separate layers 3.

The first drive unit B is a tower arrangement comprising six clusters of rollers, the clusters being fixed vertically one above the other. Each cluster 5-7 comprises spaced opposed drive rolls 5-6 surmounted by a large nip roll 7. The fibre layer 3 passes beneath the drive rolls 5 and 6 and over the nip roll 7 in such a manner that the cluster acts as a self-tensioning device. The drive unit B, therefore, also acts as a tension unit. The drive unit B further comprises idler rolls 4 and 8, respectively.

The layers 3 make three separate passes 9-11 in the stage C of the oven C, D and again three passes 13-15 in the stage D.

Figure 10:
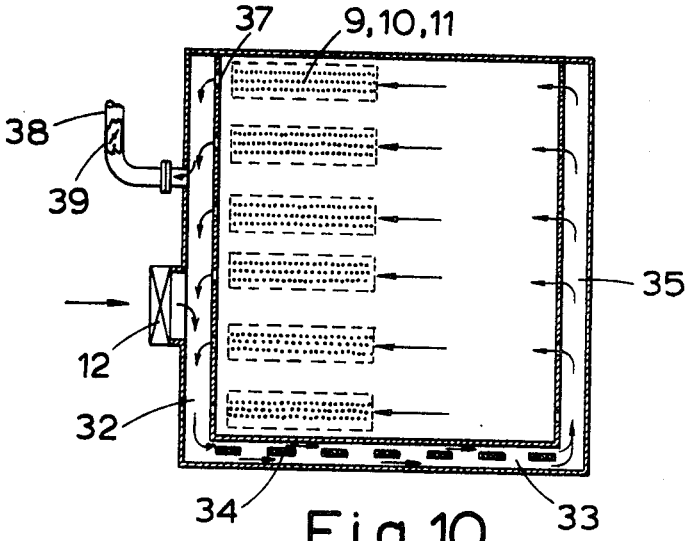
FIGS. 10–14 are detail views of particular units of the apparatus of FIGS. 1–9, FIG. 10 being a section of part of one unit, FIG. 11 an end view of a detail of FIG. 10, FIG. 12 a side view corresponding to FIG. 11, FIG. 13 a side view of a detail of another unit and FIG. 14 an end view corresponding to FIG. 13.
Figure 11:
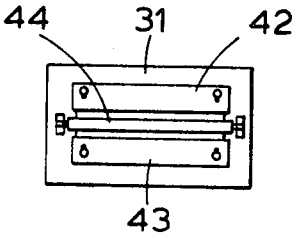
Figure 12:
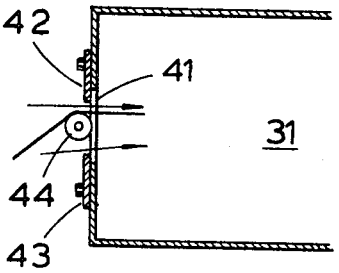

FIG. 10 is a partial section of the oxygenation stage C and FIGS. 11 and 12 are respectively an end view and a side view of an extension box 31 at the inlet to the stage C. The inlet box 31 has an entry slot 41 partly impeded by adjustable plates 42-43 and an idler roller 44. The layer 3 enters the partly masked slot 41 in contact with the top or bottom of the roller 44. The layer 3 should enter the slot 41 at an upward or downward inclination since horizontal entry causes "panting" or vibration of the fibre. The box 31 acts as a preheat zone and allows a temperature gradient to be established in the fibre entering the oxygenation stage C for example. Thus, the layer 3 is only gradually heated up to the temperature prevailing within the interior of the stage C. This prevents too rapid an increase in temperature which might result in degradation of the fibre. The layers are heated by means of transverse hot air currents. Fresh atmospheric air is drawn into the stage C through slots such as the slot 41 and hot air is continuously circulated through the inside of the stage C. A fan 12 blows hot air downwardly via a first plenum chamber 32 into the hollow base 33 of the oven C containing electric heaters 34 which maintain the circulating air at the desired temperature. The air flows from the base 33 into a second plenum chamber 35. The air leaves the second chamber 35 through slots 36 and travels across the paths 9-11 of the layers 3 returning to the first chamber 32 via corresponding slots 37. An exhaust duct 38 provided with a valve 39 bleeds out part of the air flow.

The second drive unit E is substantially identical with the first drive unit B and comprises similar roll clusters 16-18 and idler rolls 19-20. A motor 44 drives both units B and E through a chain and sprocket transmission 45 and chain and sprocket linkages 46 which ensure that the drive units B and E rotate at the same speed. The natural tendency of the layers 3 to shrink is resisted by the drive units B, E which maintain the fibre layers 3 in tension during travel. Gearing (not shown) may be introduced into the transmission 45 to allow the drive unit E to be driven slightly faster than the drive unit B, preferably 2% faster. This ensures that the layers 3 are in tension from the start and that the tension is maintained.

Figure 13:
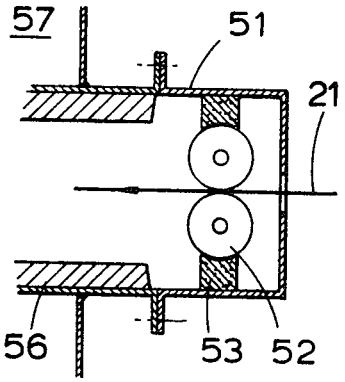
Figure 14:
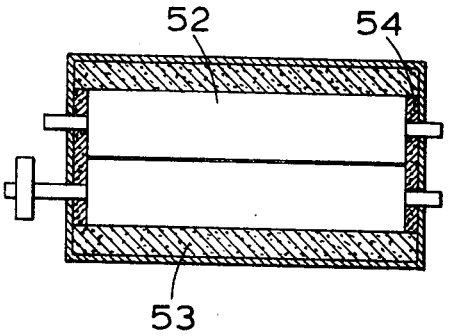

The layers 3 leaving the outlet rolls 20 of the unit E converge at 21 and enter the first furnace F through a gas seal 22 whose construction is shown in FIGS. 13 and 14. The composite fibre sheet 21 enters the furnace tube 51 between rubber covered rollers 52. The rollers 52 are in rubbing contact with graphite blocks 53 which both ensure a sufficient lateral seal for the rollers and avoid the build-up of static electricity on the rollers. The rollers should be prepared at start-up by being rubbed with graphite so as to have an initial graphite coating. Polytetrafluoroethylene washers 54 at the ends of the rollers 52 achieve end sealing of the rollers. As in the case of subsequent units, the drive from the motor 55 is via a slipping clutch to maintain the fibre sheet 21 in sufficient tension during its travel. The furnace duct 51 is lined with graphite tiles 56 which protect the walls of the duct and support it in operation. The heating chamber 57 surrounding the duct comprises conventional electrically heated ceramic elements (not shown).

The two furnaces F and G operate at different temperatures, e.g. a temperature in the range of 600°–700° C for the first furnace F and a temperature in the range of 1050°–1600° C for the second furnace G. Therefore, stainless steel may be safely used for the furnace F and a high temperature resistant steel need only be used for the furnace G. Such a steel may be for example, a high nickel alloy such as Nimonic or Inconel (trade marks). A non-oxidising atmosphere is maintained in both furnaces. In the illustrated embodiment, gas is supplied through the seals 22 at the ends of each duct 51 and is exhausted from the centre of the duct. The gas may be scrubbed and recirculated if desired. We normally employ an inert gas atmosphere. Nitrogen is preferred but argon or other similar inert gases may be used instead in special cases.

A simple tensioning device 81 consisting of three idler rollers over which the fibre sheet 21 passes in tight contact is provided between the oxidation ovens C and D. This assists in preventing "panting".

The carbonised composite fibre sheet 21 leaving the outlet gas seal 22 of the second furnace G is separated again into six layers 82 which are wound up onto the wind-up unit H.

The drives 83 of the wind-up unit, like the furnace drives 55, are provided with slipping clutches (not shown) so that they can be run at speeds which maintain the fibre in tension. In contrast, the creel unit A is simply provided with friction loading or braking (not shown).

Figure 17:
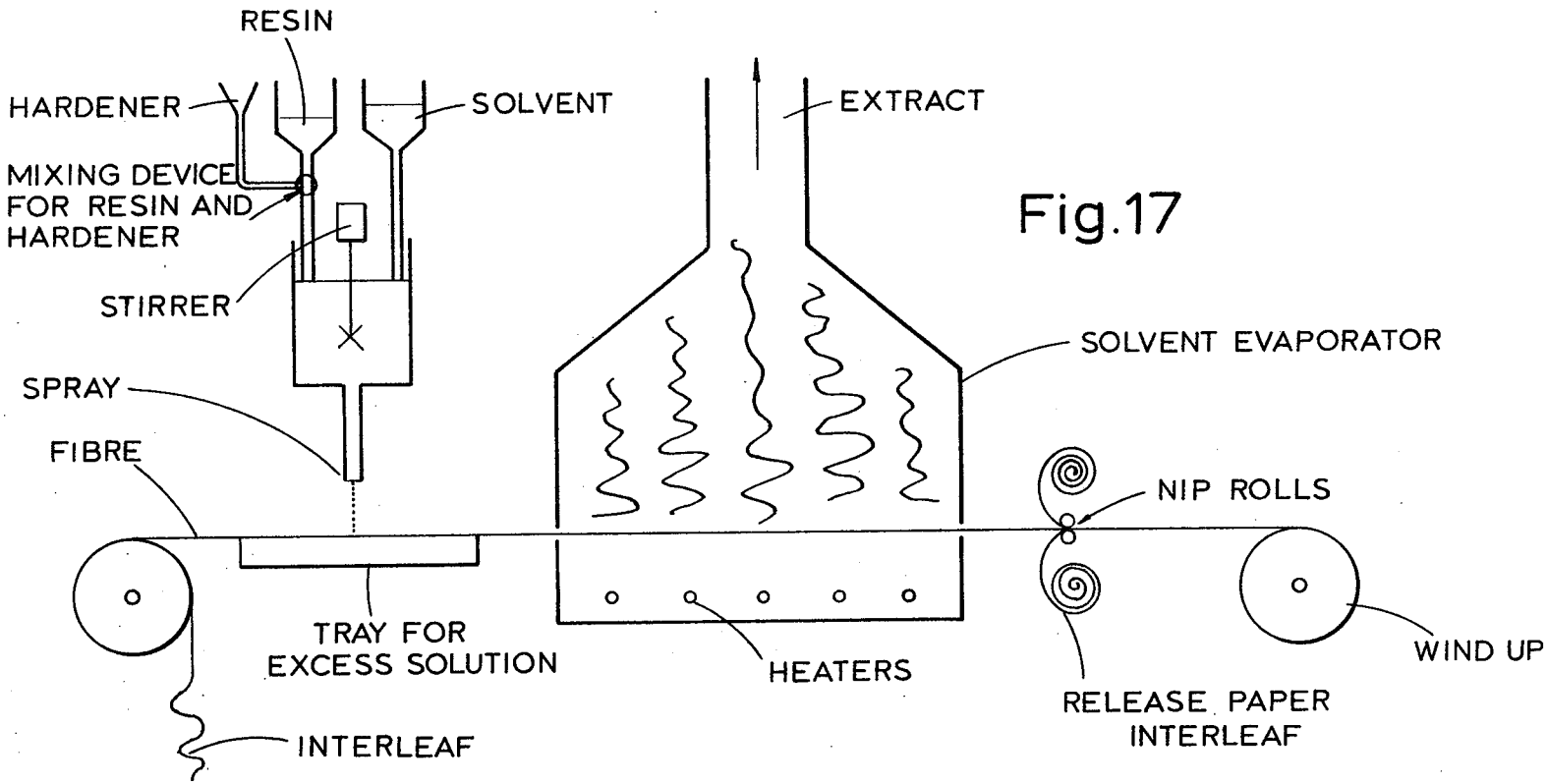

The layers 82 wound onto the respective reels 84 of the wind-up unit H are resin impregnated. Various conventional devices (not shown) may be used off-line for this purpose, e.g. dipping, roller transfer, or spraying devices. The resins used are also of conventional type as previously proposed in the art, e.g. epoxy resins such as the novolac resins, phenolic resins, polyester resins or alkyd resins. FIG. 17 shows a conventional impregnation device which may be in line if desired.

Figure 16:
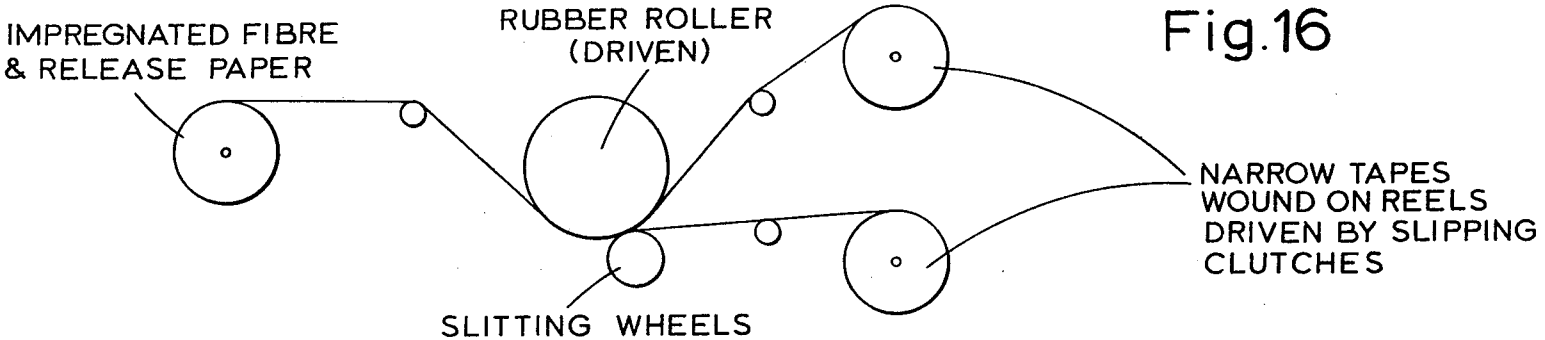

Another off-line device of conventional type (FIG. 16) is a slitting device which allows tapes of different widths to be obtained from the resin-impregnated carbonised or graphitised fibre.

Figure 15:
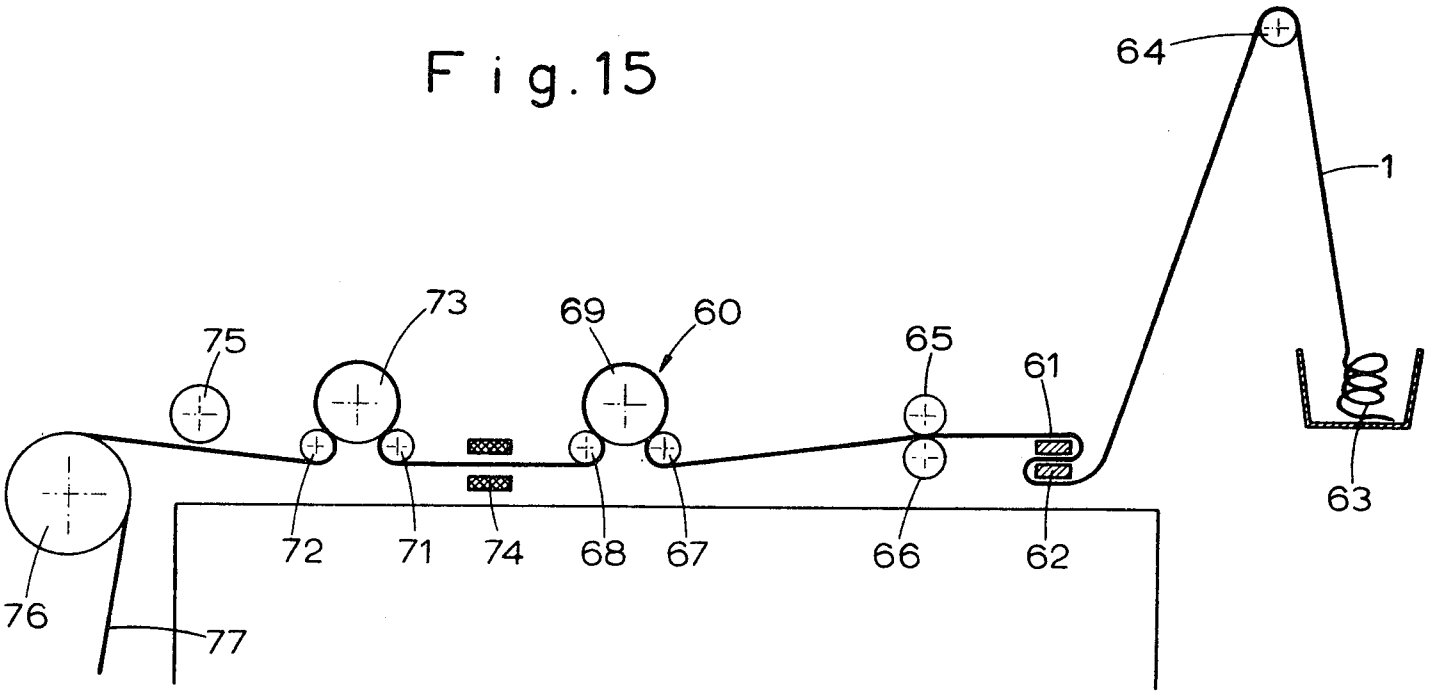
FIGS. 15 to 17 are flow sheets of auxiliary devices.

FIG. 15 is a flow-sheet of an off-line de-crimping and stretching device 60. Precursor fibre 1 is normally commercially supplied as a tow packed in a bale. The fibre needs to be stretched and, if crimped, to be decrimped before being fed to the carbon fibre producing apparatus A-H.

The device 60 of FIG. 15 comprises a crimp breaker 61 consisting of a pair of rectangular section rods 62 superimposed on one another. The fibre 1 is unrolled or otherwise fed to the crimp breaker 61 from the bale 63 over a roller 64 at a considerable height above the device. The fibre 1 winds around the rods 62 and describes an S-shaped path. It then passes between a pair of pneumatic drive rollers 65-66 which pull the fibre through the crimp breaker 61. The upper roller 65 is of uncoated steel and the lower roller 66 is rubber-covered. The fibre then passes through and over two pairs of roller clusters 67-69 and 71-73 of the same construction and operation as the roller clusters 5-7 and 16-18 of the drive units, B, E. The clusters 67-69 and 71-73 act similarly as tension units. The rollers 71-73 run very much faster than the rollers 67-69 so as to stretch the fibre 1. The speeds of the rollers are adjusted to give the right degree of stretch depending on the fibre used. A conventional electric bar heater 74 between the two clusters helps to stretch the fibre. The fibre 1 then passes adjacent to an antistatic device 75 and is wound onto a beam 76 with a paper interleaf 77.

The denier of the usual precursor fibre of commerce may vary from 1.5 denier to 3 denier or even 5 denier. The device 60 reduces the denier of the fibre to values of from 1 to 2 depending on the fibre treated and the desired degree of stretching. In our experience, the initial reduction by stretching of the denier value of the fibre which is to be oxygenated, carbonised and optionally graphitised leads to better Young's modulus and tensile strength values in the finished product.

The invention is illustrated by the following Examples, in which apparatus as shown in the accompanying drawings is used.

EXAMPLE 1

Ten tows of commercially available acrylic heavy tow fibre (each of 3 denier filament, 160,000 fils. per tow) were stretched simultaneously by passage through a heater at 130° C and wound on a spool. The fibres were collimated to form a uniform web 46 inches wide and were stretched in the heater such that their denier was reduced from 3.0 to 2.2.

These fibres were then passed through the preheat zone to the oxidation oven I and had a residence time in this zone at 185° C of 16 minutes. They then passed into the two oxidation ovens, arranged to have temperatures of 230° C and 270° C respectively. During the passage through the ovens the fibrous web was stretched by 50%. After a time of between 2 and 4 hours the fibres were permeated with oxygen to such a degree (but not completely permeated with oxygen) as to render them infusible when subjected to further heat treatment in the first of the carbonising furnaces. After passing through the second carbonising furnace, arranged to have a temperature of 1300° C, the fibres were tested by holding single fibres between clamps one inch apart and measuring the extension to break for each fibre.

From the results obtained it was found that the fibres had an average ultimate tensile strength of 506,000 p.s.i. and a Young's modulus of $34.2 \times 10^6$ p.s.i.

The cross-sectional area of these fibres was measured and found to be 36 sq.microns.

EXAMPLE 2

Several tows of Orlon (made by Dupont) acrylic fibre (as used by the textile trade) in the form of filaments each of 3 denier and having 160,000 filaments per tow are taken vertically out of their packages, over a horizontal bar, and passed over collimating bars before being passed between heated platens where they are stretched at 130° C to produce filaments having a denier of between 1.5 and 2.0.

The resulting sheet of these filaments is wound onto a spool - known in textile circles as a "beam". The length of fibre on this beam may be up to 4,000 yards.

Several such beams are then mounted on a creel and the fibres are unwound and passed through roller clusters and through the two oxidation ovens. Each sheet of fibre passes through slots in the oven walls so that the sheets are separated by a minimum of 4 inches. The fibres are restrained by roller clusters at input and exit ends of the ovens. The speed of passage through the oven is arranged to give a two hour total process time.

On entering the pre-heat zone of Oven I the fibres are subjected to a temperature of 185° C for 10 minutes. This temperature is at least 100° C below the critical temperature for acrylic fibres such as Orlon. The temperature in the oven is controlled by thyristor controllers so as to be constant within ± 2° C.

Forced air in the ovens serves to keep the temperature uniform and at the same time removes unwanted reaction products from the fibres undergoing oxidation. Air is bled off from the ovens so that the volume of air in the ovens is changed completely every two minutes.

After remaining at 180° C for 10 minutes, the fibres pass into the Oven I proper where they are subjected to a temperature of 240° C. The length of the oven is arranged to give a residence time in this oven of 55 minutes. The fibres then exit Oven I and pass into Oven II where they experience a temperature of 275° C for 1 hour.

During their transit of the ovens the fibres make no contact with any bars or rollers - this is to equalise all filament tensions at all stages of the oxidation process. Extra rollers or bars are undesirable because they can cause a "capstan" effect which can produce different tensions at different stages of the process.

After passing out of Oven II and through the exit rollers, the fibre sheets are brought together to form one thick sheet which then passes through a rotating gas seal and into the first of the two furnaces. This furnace is arranged to have a maximum temperature of 600° and a temperature gradient between the hottest point in the middle and the inlet end.

During passage through this furnace, a slight stretching tension of 1 inch per foot width (to keep the filament straight) is applied.

Nitrogen gas is introduced into the furnace and serves to keep out any air which would oxidise the fibres.

After passing through the first furnace the fibres pass into a second furnace whose temperature is fixed at a maximum of 1600° C. A tunnel is arranged between the first furnace and the second furnace so that the fibres are not exposed to the air.

After leaving the second furnace the fibre sheets are wound onto spools. Properties of the single filaments as measured by normal filament testing methods were found to be:

Youngs modulus - $32 \times 10^6$ p.s.i.

Tensile strength - 285,000 p.s.i.

If desired, these fibres can be used in conjunction with epoxy resins to produce reinforced composite materials.

We claim:

1. A method of making carbon fibre, comprising passing a multifilament commercial heavy tow of fibres formed of an acrylonitrile polymer or copolymer through an initial heating stage at a temperature in the range of from 100° to 160° C whilst holding it under sufficient tension to remove crimp and to stretch the fibres by up to 75%; passing the thus heated and stretched multifilament heavy tow through a pre-heat zone maintained at a temperature at least 100° C below the critical temperature of the fibres; passing the thus pre-heated multifilament heavy tow through an oxygenation zone comprising at least two stages, a first stage in which the multifilament heavy tow is contacted with an oxygenation medium selected from the group consisting of oxygen and oxygen-containing gases, gradually heated up to a first temperature in the range of from 220° to 250° C, at which the fibres are able to take up oxygen without degradation and maintained at that temperature, and a second stage in which the partly oxygenated multifilament heavy tow of fibres is further heated in the presence of an oxygenation medium to a second higher temperature, in the range of from 260° to 300° C, and is maintained at that second temperature, the multifilament heavy tow of fibres passing straight through each stage of the oxygenation zone without a change in direction within either of such stages, the fibres being held under sufficient uniform tension within the oxygenation zone to stretch the fibres by at least 50% during heating and oxygenation; and thereafter passing the multifilament tow of oxygenated fibres through a carbonizing zone comprising at least one stage in which the multifilament heavy tow of fibres is heated to a third elevated temperature in the range of from 1050° to 1600° C under non-oxidizing conditions to yield a fibre with a mean Young's modulus of at least $25 \times 10^6$ p.s.i. and a mean tensile strength of at least 250,000 p.s.i.

2. A method as claimed in claim 1, wherein the residence time of the multifilament tow in the pre-heat zone is in the range of from 10 to 30 minutes.

3. A method as claimed in claim 1, wherein the temperature of the pre-heat zone is in the range of from 170° to 200° C.

4. A method as claimed in claim 1, wherein the residence time of the multifilament tow in the oxygenation zone is from 2 to 4 hours.

5. A method as claimed in claim 1, wherein the carbonizing zone comprises at least two stages, namely, a first stage in which the multifilament tow of fibres is heated at a first elevated carbonising temperature in the range of from 600° to 700° C and a second stage in which the fibres are heated at a second, higher, elevated carbonizing temperature in the range of from 1050° to 1600° C, the carbonizing zone being maintained under non-oxidizing conditions.

6. A method as claimed in claim 1, wherein the carbonizing zone comprises at least one further heat treatment stage at which the multifilament tow is heated under non-oxidizing conditions to a temperature in the range of above 1600° C.

7. A method as claimed in claim 6 wherein the carbonizing zone comprises a third carbonizing stage at which the fibres are heated under non-oxidizing conditions to a temperature in the range of from above 1600° C to 3000° C.

8. A method as claimed in claim 7, wherein the fibres are heated in the carbonizing zone up to a maximum temperature of 2000° C.

9. A method according to claim 1, in which a plurality of multifilament tows are simultaneously passed through the oxygenation zone.

10. A method of making carbon fibre in accordance with claim 9, wherein the plurality of multifilament tows are brought into contact with the immediately adjacent layers and passed through the carbonizing zone in said contacted condition.

11. A method of making a carbon fibre in accordance with claim 10, wherein the multifilament tows enter the oxygenation zone having a vertical, upward or downward, inclination.

12. A method as claimed in claim 1, wherein each filament of the precursor fibre is in the range of from 1½ to 5 denier.

13. A method as claimed in claim 1, wherein the fibres in the oxygenation zone are held under tension, the fibres being held at points outside of the oxygenation zone, such that the fibres pass in a straight line through each stage of the oxygenation zone and the points at which the fibres are held under tension are all located outside of the oxygenation stages.

14. The method in accordance with 13, wherein the fibres are held between rollers located in the preheating stage upstream of the first oxygenation stage, and intermediate stage located between the first oxygenation stage and the second oxygenation stage and downstream of the second oxygenation stage.

15. A method as claimed in claim 13, wherein the heavy tow is passed through each oxygenation stage for at least three passes to thereby allow extended contact between the fibres and the oxygenation medium within each stage, the fibres changing direction between each pass by being passed around rollers located outside of each oxygenation stage, whereby the change of direction of the fibres occurs at a lower temperature than is present in the oxygenation zone.

16. A method as claimed in claim 1, wherein the carbonised fibre tow is impregnated with a desired resin at least after the carbonisation stage.

17. A method as claimed in claim 16 in which a sheet formed of a plurality of multifilament commercial heavy tows of fibres is preheated and oxidised, carbonised, optionally subjected to an additional high temperature heat treatment, impregnated with resin and thereafter slit into tapes of desired width.

* * * * *